United States Patent [19]

Kitutaka

[11] 4,097,956

[45] Jul. 4, 1978

[54] HYDRAULIC DOOR OPERATOR WITH OVERTRAVEL RESTRAINT

[75] Inventor: Hiromu Kitutaka, Fuchu, Japan

[73] Assignee: Ryobi, Ltd., Fuchu, Japan

[21] Appl. No.: 783,596

[22] Filed: Apr. 1, 1977

[30] Foreign Application Priority Data

Apr. 2, 1976 [JP] Japan ..... 51-41417[U]

[51] Int. Cl.[2] ..... E05F 3/10; E05F 3/22

[52] U.S. Cl. ..... 16/52; 16/62

[58] Field of Search ..... 16/49, 51, 52, 62, 58, 16/66, 82, 84; 292/341.12

[56] References Cited

U.S. PATENT DOCUMENTS

| | | | |
|---|---|---|---|
| 3,284,841 | 11/1966 | Patriquin | 16/52 |
| 3,675,270 | 7/1972 | Jentsch | 16/62 X |
| 3,701,180 | 10/1972 | Jentsch et al. | 16/52 |

FOREIGN PATENT DOCUMENTS

| | | | |
|---|---|---|---|
| 2,363,988 | 6/1974 | Fed. Rep. of Germany | 16/52 |

*Primary Examiner*—Ronald Feldbaum

*Attorney, Agent, or Firm*—Sughrue, Rothwell, Mion, Zinn and Macpeak

[57] ABSTRACT

A door operator mechanism includes a spring biased piston 5 having a non-return valve 6 in its end face slidably disposed in a hydraulic cylinder 3 and coupled to a door lever arm through a pinion shaft 11, a pinion gear 9, and a tooth rack 7 on the piston. If the door is opened beyond a normal angle a rod member 16 disposed within the spring 4 engages and compresses a resilient member 15 disposed between one end of the cylinder and the spring. The resilient member has a higher coefficient of resiliency than the spring and thus is not initially compressed thereby, and its restraining force increases sharply at high compression ratios, to thereby increasingly resist door overtravel.

4 Claims, 6 Drawing Figures

HYDRAULIC DOOR OPERATOR WITH OVERTRAVEL RESTRAINT

BACKGROUND OF THE INVENTION

The present invention relates to a hydraulic/spring door operator with an overtravel restraint for preventing excess opening due to high wind force or the like.

Conventional door operators rely on hydraulic pressure and/or spring compression to provide controlled opening and closing forces, and typically employ a positive mechanical limit stop when the door reaches its extreme opening travel. Such mechanisms, the typical mounting and linkage arrangement of which is shown in FIG. 1, are characterized by a sharp reduction in the restraining force at opening angles above approximately 130°, as shown by curve (a) in FIG. 2. This is due, inter alia, to the decreasing pinion axis rotation at high opening angles, as shown in FIG. 3, the decrease in the spring force as it approaches its maximum compression, as shown by curve (b) in FIG. 2, and the changing mechanical advantage of the two pivotally connected level arms coupled between the door frame and the pinion axis of the operator mechanism. As a result, if a severe opening force is applied, as when a high wind catches the door as it is being opened, the door handle is frequently jerked out of the operators hand and the door is rapidly thrust against the limit stop in the mechanism to cause the rupture or damage thereof.

SUMMARY OF THE INVENTION

It is therefore an object of the present invention to overcome the above-mentioned drawbacks and disadvantages, and to provide a compact and reliable door operator mechanism which embodies an increasingly resistive overtravel restraint when the door is opened beyond its normal opening angle.

Briefly, this object is realized by providing, in addition to the conventional hydraulic and spring mechanism, a resilient member made of, for example, urethane rubber having a larger coefficient of resiliency than that of the spring. The spring functions to control the ordinary door rotation at normal opening angles, and the resilient member provides an overtravel braking restraint against severe opening forces, such as high wind pressure.

DETAILED DESCRIPTION OF THE PREFERRED EMBODIMENTS

Figure 1:
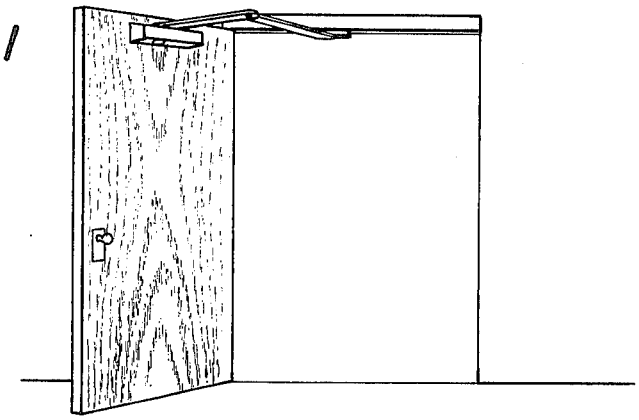
FIG. 1 shows a perspective view of a door operator mechanism mounted with pivotal lever arms.
Figure 5:
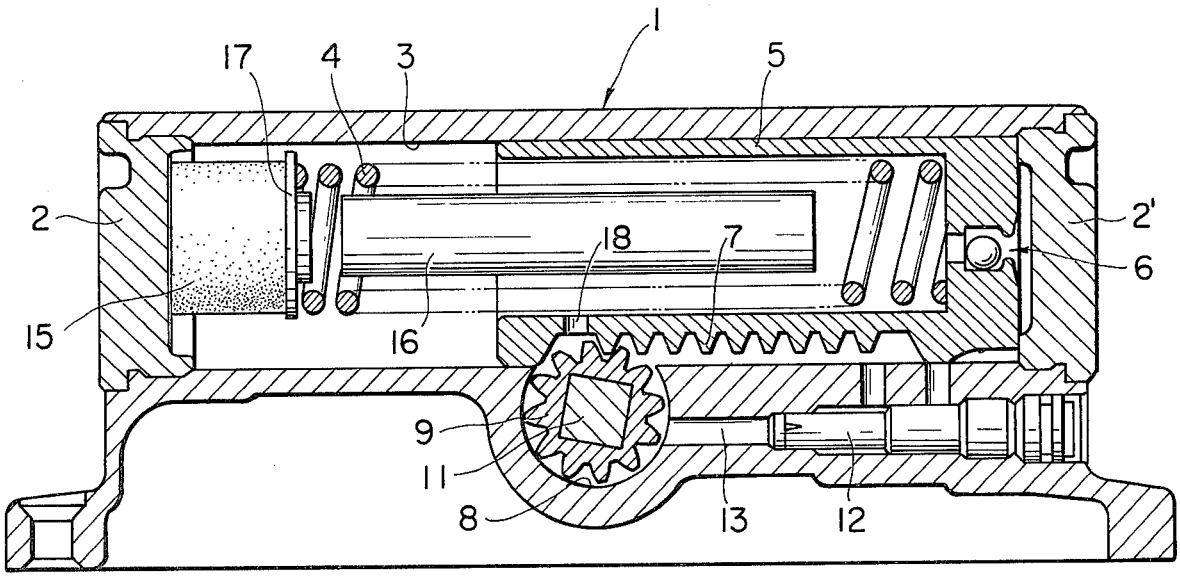
FIG. 5 shows a longitudinal sectional view of the door operator mechanism according to the present invention with the door closed.

In FIG. 5, a piston 5 biased by a spring 4 is slidably disposed in a cylinder 3 in a housing 1 whose ends are sealed by a pair of plugs 2, 2'. The end wall of the piston 5 is provided with a non-return valve 6 which prevents oil in cylinder chamber 14 from flowing through the piston into spring chamber 19. The outer peripheral surface of the piston is provided with a tooth rack 7, the length of which is substantially equal to the "angular" length of the door opening angle. A pinion chamber 8 is provided on the housing 1 adjacent the piston 5, and houses a pinion gear 9 mounted on a pinion shaft 11 externally coupled to a lever or linkage arm, as best shown in FIG. 1. The pinion chamber 8 communicates with the oil chamber 14 in cylinder 3 through an oil passage 13 and a dual orifice bleed valve 12, and with the spring chamber 19 through a passage 18 in the piston skirt.

A resilient member 15 made of urethane rubber or the like and having a larger resiliency coefficient than the spring 4 is fixed to the end plug 2, and its inner face is seated against one end of the spring 4 via a pedestal washer 17. A rod member 16 is freely and co-axially disposed within and supported by the spring 4. The resilient member 15 and rod member 16 are so dimensioned that during ordinary door rotation the resilient member is not compressively engaged by the rod member, but when the door opening angle exceeds approximately 100° the resilient member begins to be compressed by the rod member.

In operation, when the door begins to open the pinion gear 9 is rotated to drive the piston 5 to the left through the rack and pinion engagement. Such piston movement overcomes the force of and compresses the spring 4, and the oil in chamber 19 flows into chamber 14 through the non-return valve 6. During such initial movement the resilient member 15 is not significantly compressed by the retracting spring 4 since its coefficient of resiliency is larger than that of the spring.

Figure 2:
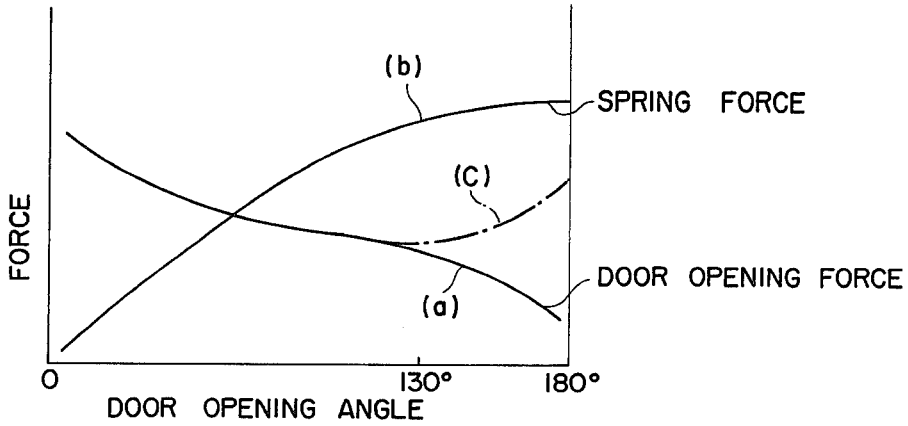
FIG. 2 shows a graph of the relationship between the door opening angle and the door opening force and spring force.
Figure 3:
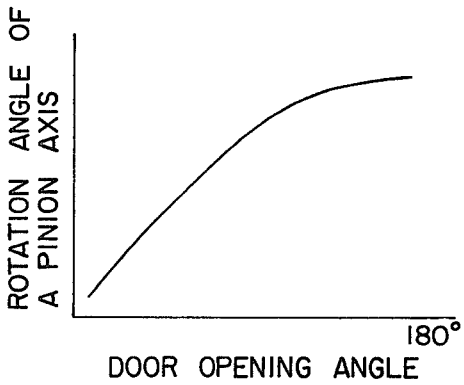
FIG. 3 shows a graph of the relationship between the door opening angle and the rotation angle of the pinion axis.
Figure 4:
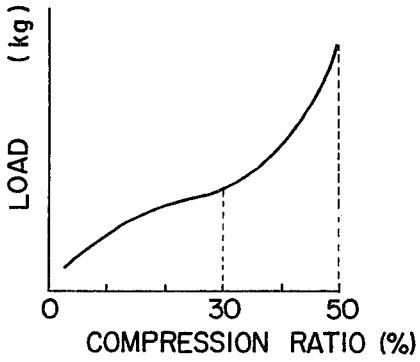
FIG. 4 shows a graph of the relationship between the compression ratio of the resilient member and the force exerted thereby.
Figure 6:
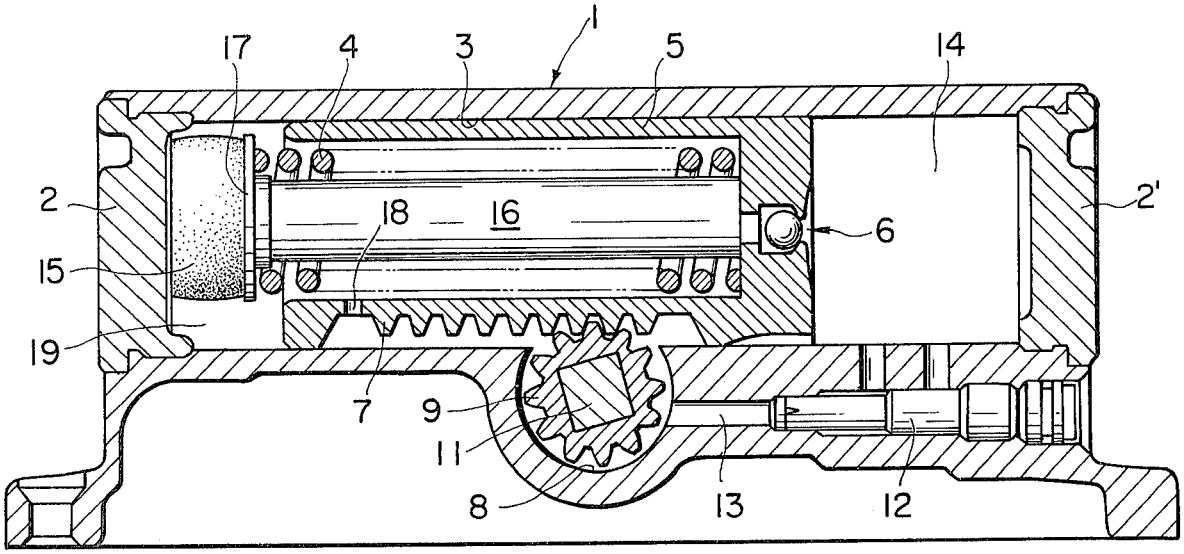
FIG. 6 shows a longitudinal sectional view thereof with the door open.

When the door is opened beyond 100°, however, the rod member 16 engages and begins to compress the resilient member 15, as shown in FIG. 6. The coefficient of resiliency of the member 15 becomes increasingly large above a compression ratio of approximately 30%, as shown in FIG. 4, whereby the restraining force produced thereby increases sharply and serves to prevent or act against any excess door opening or overtravel. The effect of the resilient member 15 is thus to bend up the tail end of the door opening force curve (a) in FIG. 2, as shown by the section line curve (c).

The closure operation is conventional, with the oil in chamber 14 flowing through both orifices in the bleed valve 12 in a parallel manner until the piston 5 seals off one of the entry ports thereto, whereafter the oil flows through both orifices in series to further slow down the final closure movement.

What is claimed is:

1. In a door operator mechanism including a housing defining a hydraulic cylinder therein, a piston slidably disposed in the cylinder, a spring member disposed within the cylinder and engaging the piston at one end to bias the piston in a first direction, and drive means operatively coupled to the piston for moving the piston in a second direction opposite to the first direction against the force of the spring member in response to the opening of a door, the improvements characterized by:

(a) a resilient member disposed in the cylinder between one end thereof and the other end of the spring member and having a higher coefficient of resiliency than the spring member, whereby the spring member alone is primarily compressed when the door is opened within a normal angular range, and (b) a rigid, unmounted rod member disposed for free axial movement within the spring member and dimensioned to become engaged between the resilient member and the inner face of the piston when the limit of said normal angular range is reached and before the spring member becomes fully compressed, whereby said rod member thereafter compresses said resilient member to increasingly resist the opening of the door beyond said normal angular range.

2. A door operator mechanism as defined in claim 1, wherein the resilient member increasingly resists further compression above a predetermined compression ratio.

3. A door operator mechanism as defined in claim 1, wherein the drive means comprises a tooth rack longitudinally disposed on the piston skirt, and a pinion gear rotationally mounted in the housing and engaged with the tooth rack.

4. A door operator mechanism as defined in claim 2, wherein the drive means comprises a tooth rack longitudinally disposed on the piston skirt, and a pinion gear rotationally mounted in the housing and engaged with the tooth rack.

* * * * *